US009227401B2

(12) United States Patent
Fujii et al.

(10) Patent No.: US 9,227,401 B2
(45) Date of Patent: Jan. 5, 2016

(54) PRINTING ELEMENT SUBSTRATE, PRINTHEAD, AND PRINTING APPARATUS

(71) Applicant: CANON KABUSHIKI KAISHA, Tokyo (JP)

(72) Inventors: Kazunari Fujii, Tokyo (JP); Masanobu Ohmura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/289,805

(22) Filed: May 29, 2014

(65) Prior Publication Data

US 2014/0375711 A1 Dec. 25, 2014

(30) Foreign Application Priority Data

Jun. 24, 2013 (JP) ..... 2013-132025

(51) Int. Cl.
*B41J 29/38* (2006.01)
*B41J 2/07* (2006.01)
*B41J 2/045* (2006.01)

(52) U.S. Cl.
CPC *B41J 2/07* (2013.01); *B41J 2/0455* (2013.01); *B41J 2/0458* (2013.01); *B41J 2/04543* (2013.01); *B41J 2/04548* (2013.01); *B41J 2202/13* (2013.01)

(58) Field of Classification Search
USPC ..... 347/9–11
See application file for complete search history.

(56) References Cited

U.S. PATENT DOCUMENTS 6,969,135 B2 11/2005 Tamura
2002/0180814 A1 12/2002 Tamura
2010/0134543 A1* 6/2010 Hirayama et al. ..... 347/10

FOREIGN PATENT DOCUMENTS

JP 2002-355970 12/2002

OTHER PUBLICATIONS

U.S. Appl. No. 14/319,073, filed Jun. 30, 2014.

* cited by examiner

*Primary Examiner* — Jason Uhlenhake
(74) *Attorney, Agent, or Firm* — Fitzpatrick, Cella, Harper & Scinto

(57) ABSTRACT

A printing element substrate, comprising a plurality of units configured to print on a printing medium based on print data, each of the plurality of units, including a printing element configured to print on the printing medium, a first transistor configured to operate as a source follower upon receiving a voltage at a gate terminal of the first transistor, and supply a current to the printing element, and a second transistor configured to control supply of the current to the printing element in response to a control signal input to a gate terminal of the second transistor.

17 Claims, 7 Drawing Sheets

FIG. 2
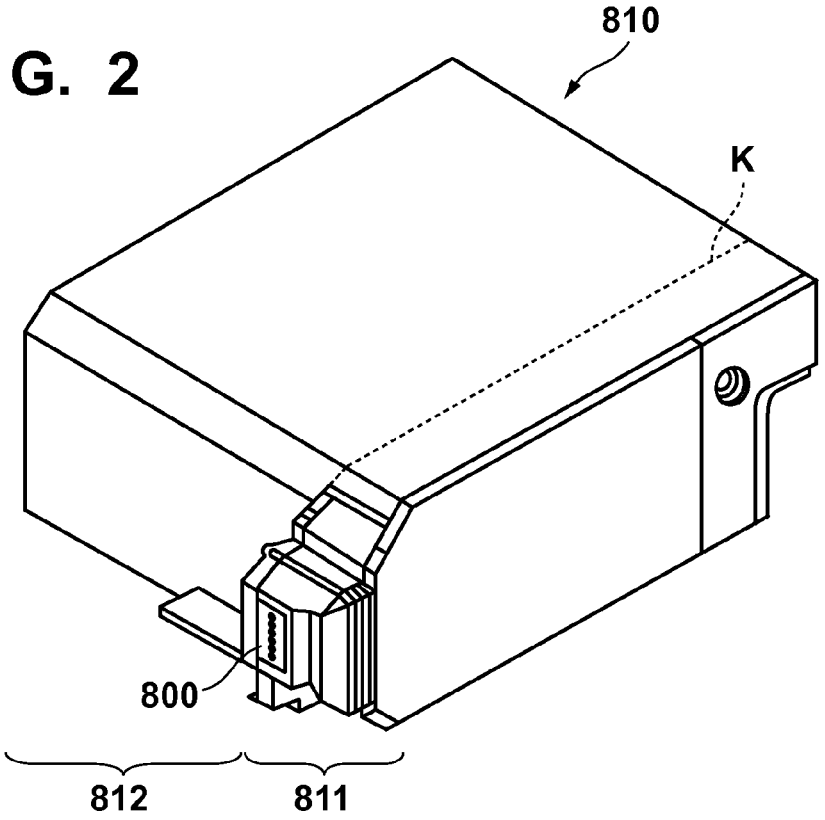
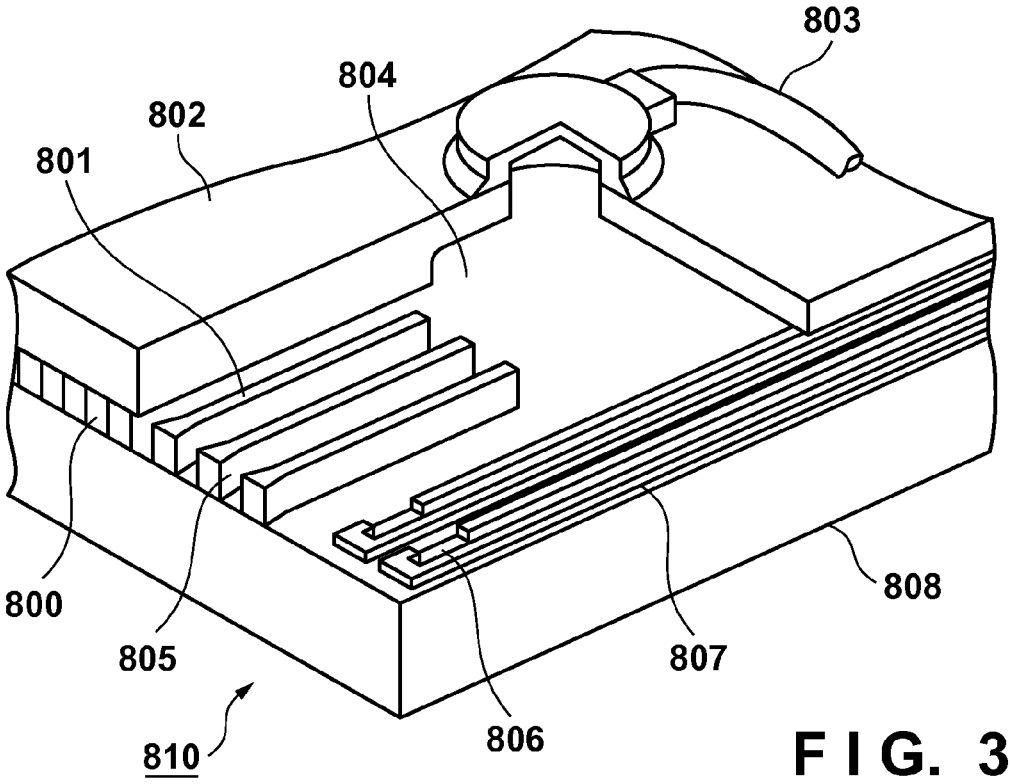
FIG. 3

PRINTING ELEMENT SUBSTRATE, PRINTHEAD, AND PRINTING APPARATUS

BACKGROUND OF THE INVENTION

1. Field of the Invention

The present invention relates to a printing element substrate, printhead, and printing apparatus.

2. Description of the Related Art

An inkjet printing apparatus typified by a printer includes a printhead which prints on a printing medium. The printhead includes a printing element substrate. Printing elements for printing based on print data, and driving transistors for driving the printing elements are arranged on the printing element substrate.

The printing elements and driving transistors are interposed between a power supply line and a ground line. At the time of printing, potential fluctuations may occur on the power supply line. The potential fluctuations become more serious as the number of printing elements to be simultaneously driven increases. The printing element substrate needs to adopt a circuit arrangement considering the potential fluctuations.

Japanese Patent Laid-Open No. 2002-355970 discloses an arrangement in which printing elements and driving transistors, and a control unit configured to supply a control signal to the control terminals of the driving transistors operate using different power supplies. In this arrangement, a control signal of a constant potential is supplied to the control terminal of the driving transistor, and the amount of current supplied to the printing element is hardly influenced by the above-mentioned potential fluctuations of the power supply. However, Japanese Patent Laid-Open No. 2002-355970 does not disclose that an element configured to supply a constant current to the printing element, and an element configured to control the printing element are arranged individually.

SUMMARY OF THE INVENTION

It is an object of the present invention to provide a printing element substrate for a printhead that is hardly influenced by potential fluctuations of a power supply line and is advantageous to the operation.

One of the aspects of the present invention provides a printing element substrate, comprising a plurality of units configured to print on a printing medium based on print data, each of the plurality of units, including a printing element configured to print on the printing medium, a first transistor configured to operate as a source follower upon receiving a voltage at a gate terminal of the first transistor, and supply a current to the printing element, and a second transistor configured to control supply of the current to the printing element in response to a control signal input to a gate terminal of the second transistor.

Further features of the present invention will become apparent from the following description of exemplary embodiments with reference to the attached drawings.

BRIEF DESCRIPTION OF THE DRAWINGS

FIG. 2 is a view for explaining an example of the arrangement of a printhead;

FIG. 3 is a view for explaining an example of the internal arrangement of the printhead;

DESCRIPTION OF THE EMBODIMENTS (Printing Apparatus)

Figure 1:
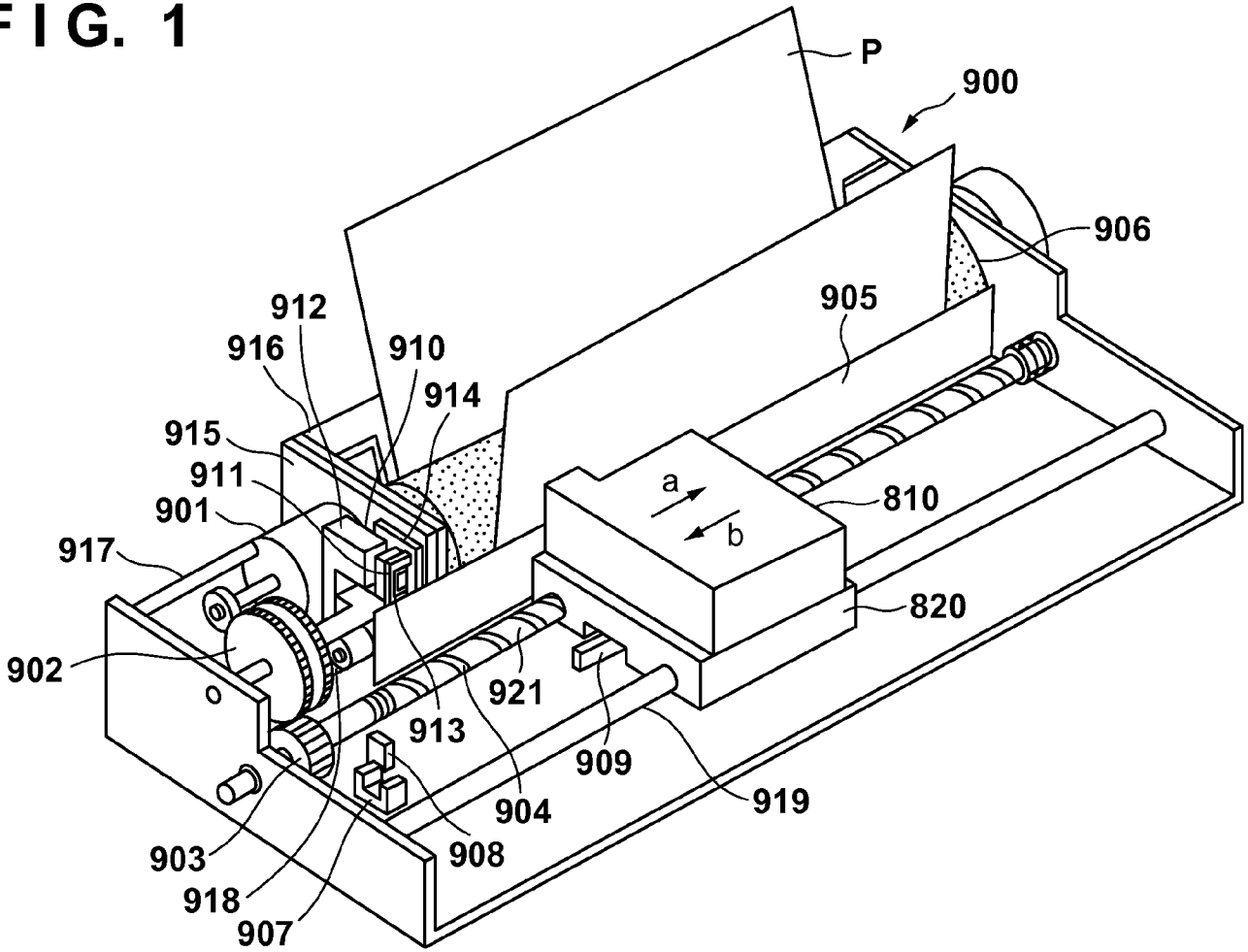
FIG. 1 is a view for explaining an example of the internal arrangement of a printing apparatus.

FIG. 1 exemplifies the internal arrangement of an inkjet printing apparatus 900 typified by a printer, facsimile apparatus, copying machine, or the like. The printing apparatus 900 includes a printhead 810 which discharges ink to a printing sheet P. The printhead 810 can be mounted on a carriage 920, and the carriage 920 can be attached to a lead screw 904 having a helical groove 921. The lead screw 904 can rotate in synchronism with rotation of a driving motor 901 via driving force transfer gears 902 and 903. The printhead 810 can move in a direction indicated by an arrow a or b along a guide 919 together with the carriage 920.

A printing sheet P is pressed by a paper press plate 905 in the carriage moving direction, and fixed to a platen 906. The printing apparatus 900 reciprocally moves the printhead 810 to print on the printing sheet P conveyed on the platen 906 by a conveyance unit (not shown).

The printing apparatus 900 checks, via photocouplers 907 and 908, the position of a lever 909 arranged on the carriage 920, and switches the rotational direction of the driving motor 901. A support member 910 supports a cap member 911 for capping the ink orifices (nozzles) of the printhead 810. A suction means 912 performs recovery processing of the printhead 810 by sucking the inside of the cap member 911 via an intra-cap opening 913. A lever 917 is arranged to start recovery processing by suction. The lever 917 moves along with movement of a cam 918 engaged with the carriage 920, and a driving force from the driving motor 901 is controlled by a known transfer means such as clutch switching.

A main body support plate 916 supports a moving member 915 and cleaning blade 914. The moving member 915 moves the cleaning blade 914 to perform recovery processing of the printhead 810 by wiping. The printing apparatus 900 includes a printing control unit (not shown), and the printing control unit controls driving of each mechanism described above.

(Printhead)

FIG. 2 exemplifies the outer appearance of the printhead 810. The printhead 810 can include a printhead unit 811 including a plurality of nozzles 800, and an ink tank 812 which holds ink to be supplied to the printhead unit 811. The ink tank 812 and printhead unit 811 can be separated at, for example, a broken line K, and the ink tank 812 is exchangeable. The printhead 810 includes an electrical contact (not shown) for receiving an electrical signal from the carriage 920, and performs the above-described printing by discharging ink in accordance with the electrical signal. The ink tank 812 includes, for example, a fibrous or porous ink holding member (not shown), and the ink holding member can hold ink.

FIG. 3 exemplifies the internal arrangement of the printhead 810. The printhead 810 includes a substrate 808, channel wall members 801 which are arranged on the substrate 808 to form channels 805, and a top plate 802 including an ink supply portion 803. As printing elements, heaters 806 (heat generating units) are arrayed in correspondence with the respective nozzles 800 on the printing element substrate (to be described later) of the printhead 810. When a driving transistor (not shown) arranged in correspondence with each heater 806 is changed to the conductive state and turned on, the heater 806 generates heat.

Ink from the ink supply portion 803 is stored in a common ink chamber 804 and supplied to each nozzle 800 via each channel 805. When the heater 806 corresponding to each nozzle 800 is driven to generate heat, the ink supplied to the nozzle 800 is discharged from the nozzle 800. Note that the ink discharge amount can increase when the ink temperature is high, and decrease when the ink temperature is low.

(System Arrangement)

Figure 4:
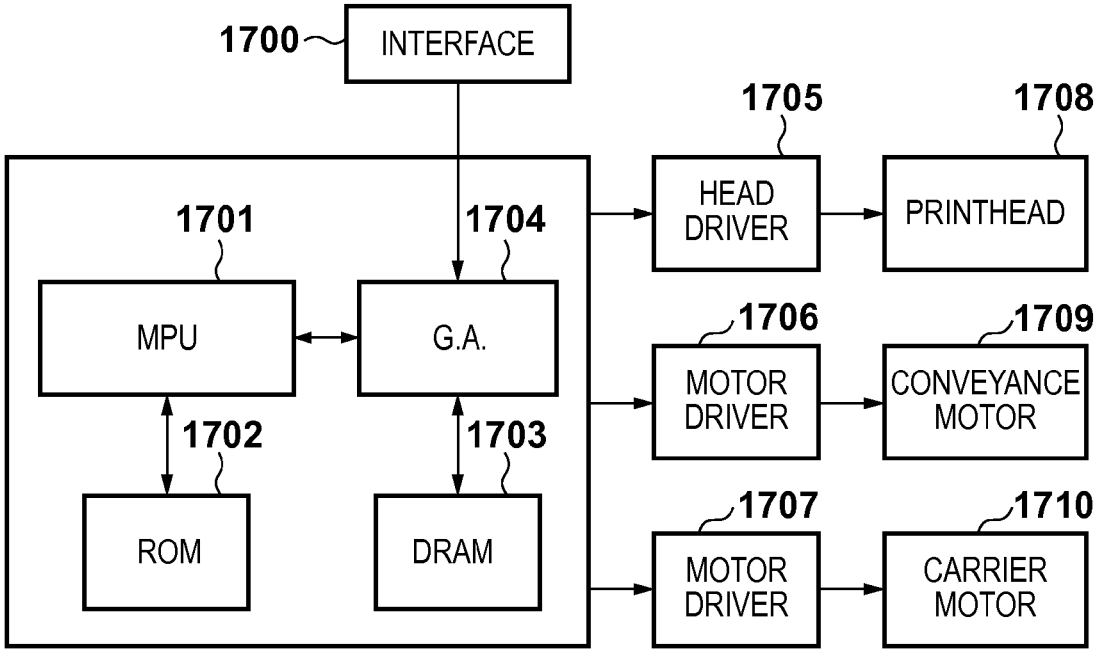
FIG. 4 is a block diagram for explaining an example of the system arrangement of the printing apparatus.

FIG. 4 exemplifies the system arrangement of the printing apparatus 900. The printing apparatus 900 includes an interface 1700, MPU 1701, ROM 1702, RAM 1703, and gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls supply of print data to the printhead 1708, and also controls data transfer between the interface 1700, the MPU 1701, and the RAM 1703.

The printing apparatus 900 further includes a printhead driver 1705, motor drivers 1706 and 1707, a conveyance motor 1709, and a carrier motor 1710. The carrier motor 1710 conveys the printhead 1708. The conveyance motor 1709 conveys a printing sheet. The printhead driver 1705 drives the printhead 1708. The motor drivers 1706 and 1707 drive the conveyance motor 1709 and carrier motor 1710, respectively.

When a print signal is input to the interface 1700, it can be converted into print data for printing between the gate array 1704 and the MPU 1701. Each mechanism performs a desired operation in accordance with the print data, thus performing the above-described printing.

First Embodiment

Figure 5:
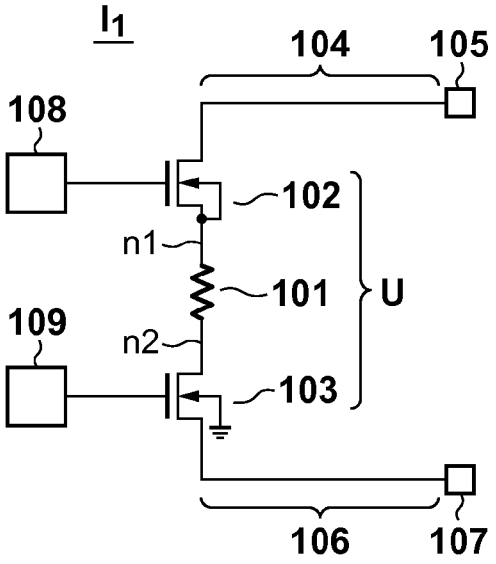
FIG. 5 is a circuit diagram for explaining an example of part of the circuit arrangement of a printing element substrate.

A printing element substrate $I_1$ according to the first embodiment will be described with reference to FIGS. 5 to 7. FIG. 5 shows part of the arrangement of the printing element substrate $I_1$. The printing element substrate $I_1$ includes a plurality of units U including heaters 101, and n-channel MOS first transistors 102 and second transistors 103, respectively. For better understanding, one heater 101, one transistor 102, and one transistor 103 are shown for one unit U.

The heater 101 functions as a printing element for printing on a printing medium. When the heater 101 is driven to generate heat, ink is discharged from the above-mentioned nozzle. More specifically, a voltage is applied across the heater 101, a current flows through the heater 101, and the heater 101 generates heat. The transistor 102 operates as a source follower when a constant voltage is supplied to the gate terminal. Then, the transistor 102 supplies a constant current to the heater 101. A control signal is input to the gate terminal of the transistor 103. In response to this control signal, the transistor 103 controls a current to be supplied to the heater 101. The transistors 102 and 103 are MOS transistors of the same conductivity type.

The transistors 102 and 103 and the heater 101 are interposed between nodes 104 and 106. When the transistors 102 and 103 are n-channel transistors, the transistor 102 is arranged to form a current path between the power supply node 104 and a first terminal n1 of the heater 101. The transistor 103 can be arranged to form a current path between the ground node 106 and a second terminal n2 of the heater 101. Note that the power supply node 104 receives a power supply voltage via a power supply electrode 105, and the ground node 106 is connected to ground via a GND electrode 107. The electrodes 105 and 107 may be pads, respectively, which receive a voltage from the outside. A potential difference Vh between the electrodes 105 and 107 is, for example, 32 [V].

To the contrary, when the transistors 102 and 103 are p-channel transistors, the potential is inverted from that when the transistor 103 is an n-channel MOS transistor. That is, the transistor 102 can be arranged to form a current path between the ground node 104 and the first terminal n1 of the heater 101. The transistor 103 can be arranged to form a current path between the power supply node 106 and the second terminal n2 of the heater 101. Note that the ground node 104 is connected to ground via the GND electrode 105, and the power supply node 106 receives a power supply voltage via the power supply electrode 107. A case in which the transistors 102 and 103 are n-channel transistors will be explained.

A power supply unit 108 supplies a constant voltage Vgh to the gate terminal of the transistor 102. The voltage Vgh is, for example, 28 [V]. The power supply unit 108 can supply the voltage Vgh to the gate terminal of the transistor 102 regardless of the potential difference between the power supply node 104 and the ground node 106. With this arrangement, the transistor 102 forms a source follower. Thus, the source potential of the transistor 102 (that is, the potential of the terminal n1) is hardly influenced by potential fluctuations of the power supply node 104 and ground node 106 that may occur upon printing. The voltage Vgh is preferably lower by the threshold voltage of the transistor 102 or more than the voltage of the drain terminal of the transistor 102. That is, the transistor 102 preferably operates in the saturation region. While a voltage is supplied to the drain terminal of the transistor 102, the power supply unit 108 continuously supplies the voltage Vgh. In other words, supply of a voltage to the gate terminal of the transistor 102 is performed in synchronism with supply of a voltage to the drain terminal of the transistor 102. Note that the source terminal and back gate terminal (bulk) of the transistor 102 are electrically connected, details of which will be described later.

In contrast, a control signal from a control unit 109 is input to the gate terminal of the transistor 103. A width Vgl of a change of the potential of the control signal is, for example, 5 [V], and this potential can change within the range of 0 to 5 [V]. It suffices to constitute the control unit 109 so as to operate by a power supply of a 5-V power supply system using a known logical circuit or buffer circuit. With this arrangement, the transistor 103 forms a source-grounded transistor, and can drive the heater 101 in response to the control signal. For example, when the gate potential of the transistor 103 is 5 [V], the transistor 103 is changed to the conductive state to drive the heater 101 (the heater 101 is turned on to generate heat). When the gate potential is 0 [V], the transistor 103 remains in the non-conductive state and does not drive the heater 101.

Note that Vh, Vgh, and Vgl have a relation of $Vgl<Vgh<Vh$ (to be referred to as the first expression hereinafter). Preferably, the transistor 103 operates in the non-saturation region.

The transistor 103 is configured not to rate-determine a constant current supplied from the transistor 102.

With the above-described arrangement, since the transistor 102 supplies a constant current to the heater 101, the printing element substrate $I_1$ is hardly influenced by potential fluctuations of the power supply line at the time of printing and is advantageous to the operation of the printing element substrate $I_1$. With this arrangement, the printing element substrate $I_1$ can be designed by individually taking account of a design to switch the state of the driving transistor, and a design to supply a constant voltage to the control terminal of the driving transistor. More specifically, the power supply unit 108 and control unit 109 can be designed individually. The power supply unit 108 is designed so that the potential of the terminal n1 of the heater 101 is fixed and a constant current is supplied to the heater 101. The control unit 109 is designed so that the gate potential Vgl of the transistor 103 changes within a desired range and the change can follow a desired frequency. The arrangement according to the embodiment facilitates the operational design of the printing element substrate $I_1$ and is advantageous to even the design of the printing element substrate $I_1$.

Note that the wiring resistances of the power supply node 104 and ground node 106 are desirably as low as possible. However, to fabricate the printing element substrate $I_1$ at a small size, the area of the region where the power supply node 104 and ground node 106 are arranged is limited. In this case, the wiring resistance of the ground node 106 is desirably set to be lower than that of the power supply node 104. When the power supply node 104 and ground node 106 are formed from the same wiring layer, the wiring width of the ground node 106 is desirably larger than that of the power supply node 104. This can reduce the influence of potential fluctuations of the power supply line caused by the wiring resistance of the power supply node 104 in the above-described arrangement. In addition, since the wiring resistance of the ground node 106 is low, potential fluctuations of the ground line can be reduced.

Figure 6:
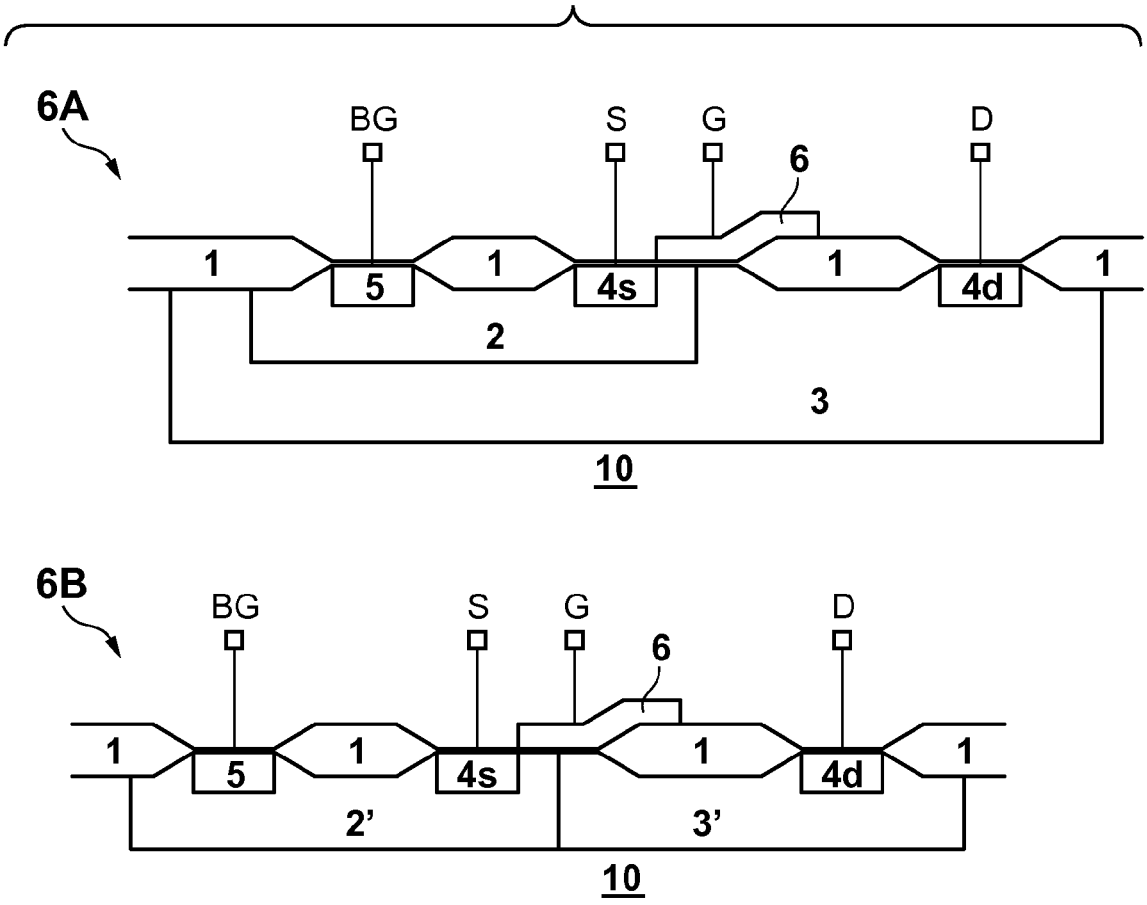
FIG. 6 is a view for explaining an example of the sectional structure of a DMOS transistor.
Figure 7:
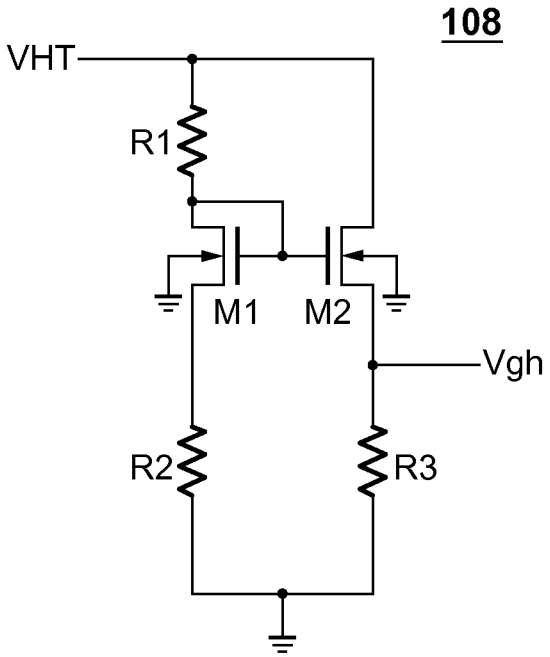
FIG. 7 is a circuit diagram for explaining an example of the circuit arrangement of a power supply unit.

FIG. 6 schematically shows an example of the sectional structures of the transistors 102 and 103 described above. As the transistors 102 and 103, DMOS transistors (Double-Diffused MOSFETs) serving as an example of high-breakdown-voltage transistors are usable. In FIG. 6, (a) exemplifies the sectional structure of the first DMOS transistor corresponding to the transistor 102. In FIG. 6, (b) exemplifies the sectional structure of the second DMOS transistor corresponding to the transistor 103. In (a) and (b) of FIG. 6, a terminal S corresponds to a source terminal, a terminal D corresponds to a drain terminal, a terminal G corresponds to a gate terminal, and a terminal BG corresponds to a back gate terminal.

The aforementioned DMOS transistor is formed using a known semiconductor manufacturing process. The manufacturing method will be described by exemplifying the first DMOS transistor (transistor 102) in (a) of FIG. 6. First, a semiconductor substrate having a p-type semiconductor region 10 is prepared. By ion implantation, an n-type well 3 can be formed in the p-type semiconductor region 10, and a p-type well 2 can be formed in the n-type well 3. The n-type well 3 is formed in the p-type semiconductor region 10 to surround the p-type well 2, and electrically separates the p-type well 2 and p-type semiconductor region 10. Then, a gate insulating film and field oxide film 1 can be formed on the semiconductor substrate, and a gate electrode 6 can be formed in a desired region on the gate insulating film and field oxide film 1. After that, by ion implantation, an n-type semiconductor region **4*s* can be formed in the p-type well 2, an n-type semiconductor region 4*d* can be formed in the n-type well 3, and a p-type semiconductor region 5 can be formed in the p-type well 2**.

The above-described wells, semiconductor regions, and gate electrode constitute the first DMOS transistor (transistor 102). The n-type semiconductor region **4*d* corresponds to the first drain region, the n-type semiconductor region 4*s* corresponds to the first source region, and the p-type semiconductor region 5 corresponds to the first p-type diffusion region. When power is supplied to the p-type semiconductor region 5 to apply a potential to the p-type well 2, and an activation signal is supplied to the gate electrode 6, an n-type channel is formed in the p-type well 2**.

As described above, the source terminal and back gate terminal of the transistor 102 are electrically connected to each other. In the above-described example, 28 [V] is applied to the gate terminal of the transistor 102. If the back gate terminal is fixed to 0 [V], insulation breakdown of the gate insulating film may occur between the p-type semiconductor region 10 and the p-type well 2 (potential of 0 [V]). Therefore, by adopting the structure exemplified in (a) of FIG. 6 for the transistor 102, the p-type well 2 and p-type semiconductor region 10 can be electrically separated while the source terminal S and back gate terminal BG are electrically connected to each other. This structure can prevent the above-mentioned insulation breakdown of the gate insulating film.

The second DMOS transistor (transistor 103) in (b) of FIG. 6 is different in structure from the first DMOS transistor in (a) of FIG. 6 in that the side walls of a p-type well 2' and n-type well 3' contact each other. The transistor 103 adopts the structure exemplified in (b) of FIG. 6 because the p-type well 2' and the p-type semiconductor region 10 need not be electrically separated. The transistor 103 can be formed with a small area, compared to the case in which the structure in (a) of FIG. 6 is adopted.

Note that the first embodiment has exemplified the structures of lateral DMOS transistors as the transistors 102 and 103. However, high-breakdown-voltage transistors having other structures may be used without departing from the purpose of the present invention.

The power supply unit 108 suffices to obtain a desired constant voltage and adopt a known circuit arrangement. FIG. 7 exemplifies the circuit arrangement of the power supply unit 108. The power supply unit 108 is constituted using resistance elements R1, R2, and R3, and transistors M1 and M2. A power supply voltage VHT can be supplied from the outside to the power supply unit 108. The power supply unit 108 can be designed so that the output voltage Vgh has a desired value by adjusting the resistance values of the resistance elements R1 to R3 and the sizes of the transistors M1 and M2.

Second Embodiment

Figure 8:
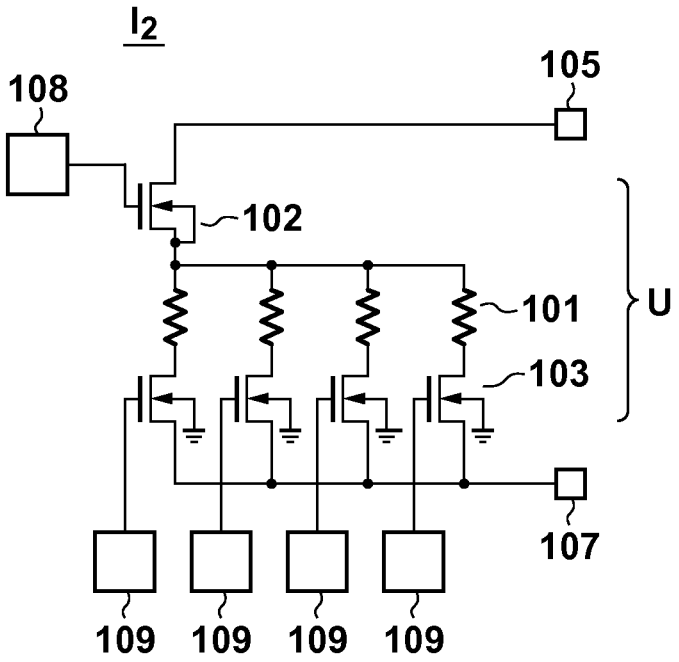
FIG. 8 is a circuit diagram for explaining another example of part of the circuit arrangement of the printing element substrate.

A printing element substrate $I_2$ according to the second embodiment will be described with reference to FIG. 8. The first embodiment has exemplified the arrangement in which one heater 101 and one transistor 103 for controlling driving of the heater 101 are arranged for one transistor 102 for supplying a constant current to the heater 101. However, the present invention is not limited to this arrangement. Each of a plurality of units U on the printing element substrate $I_2$ exemplified in FIG. 8 may include one transistor 102, a plurality of heaters 101, and a plurality of transistors 103.

Each of the plurality of transistors 103 can adopt the structure of the DMOS transistor exemplified in (b) of FIG. 6. Each of the plurality of transistors 103 can be arranged to share an n-type semiconductor region **4*s* as a source region. Thus, the plurality of transistors 103 can be formed with an small area, compared to the case in which the structure of the DMOS transistor exemplified in (a) of FIG. 6 described above is adopted. However, each transistor 103 has a drain region and gate electrode independently of another transistor 103 in order to prevent short-circuiting with another transistor 103** in the operation.

As described above, the second embodiment is advantageous to the operation and design of the printing element substrate $I_2$, as in the first embodiment. Further, the plurality of transistors 103 for controlling driving of a plurality of printing elements can be formed with a small area.

Third Embodiment

Figure 9:
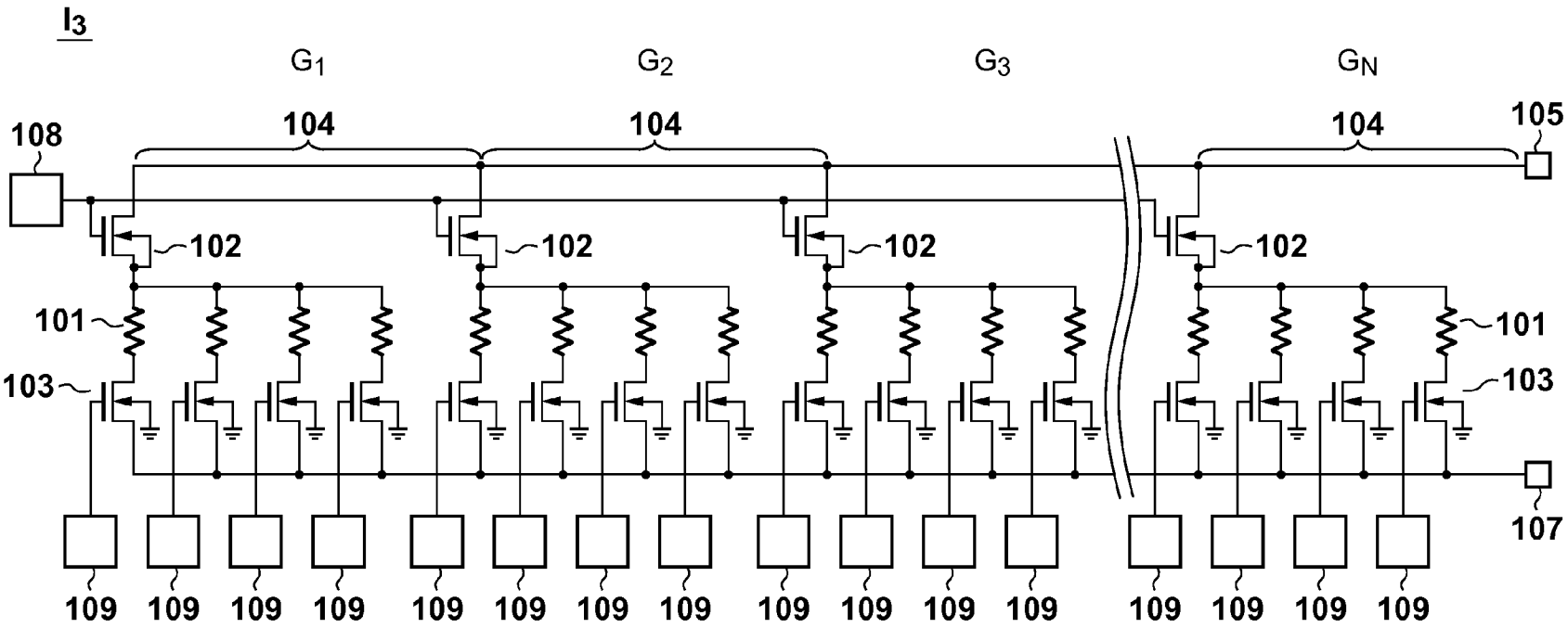
FIG. 9 is a circuit diagram for explaining another example of part of the circuit arrangement of the printing element substrate.

A printing element substrate $I_3$ according to the third embodiment will be described with reference to FIG. 9. As exemplified in FIG. 9, respective units U on the printing element substrate $I_3$ form groups G ($G_1$ to $G_N$) and can operate according to the time-divisional driving method. More specifically, each control unit 109 can output a control signal to the gate terminal of a corresponding transistor 103 to drive each heater 101 in each group G by the time-divisional driving method. More specifically, the control unit 109 outputs a signal for deciding a group G to be selected, and a signal for deciding a heater 101 to be driven in each group G.

This arrangement can reduce the influence of heat energy generated upon driving the heater 101 on the adjacent heater 101. When one heater 101 in each group G is driven, a maximum of N heaters 101 can be simultaneously driven, and potential fluctuations of a power supply node 104 and ground node 106 may become serious. However, a power supply unit 108 supplies a constant voltage to the gate terminal of a transistor 102, and the amount of current flowing through each heater 101 is hardly influenced by the potential fluctuations, as described above.

As described above, even the printing element substrate $I_3$ in the third embodiment can obtain the same effects as those in the first and second embodiments. The printing element substrate $I_3$ can operate properly even under power supply potential fluctuations which may occur when a plurality of printing elements are driven by the time-divisional driving method.

In the third embodiment, a maximum of N heaters 101 can be simultaneously driven, so the potential of the drain terminal of the transistor 102 may drop greatly. Considering this, a constant voltage Vgh supplied from the power supply unit 108 desirably satisfies $Vgl<Vgh<(Vh-(N\times(N+1)/2)\times I_{ON}\times R_h)$ (to be referred to as the second expression hereinafter), where $I_{ON}$ is the amount of current flowing through one heater 101, and $R_h$ is the wiring resistance between the adjacent transistors 102 in a line pattern corresponding to the power supply nodes 104. Note that the upper limit value of Vgh in the second expression is the potential of the drain terminal of the transistor 102 for which the voltage drop of the power supply node 104 is largest among the plurality of transistors 102 when the N heaters 101 are driven simultaneously. For example, when Vh=32 [V], N=32, $I_{ON}$=100 [mA], $R_h$=0.1 [Ω], and Vgl=5 [V], the second expression is 5 [V]<Vgh<26.72 [V]. The voltage Vgh suffices to satisfy the second expression described above. However, for example, when discharging high-viscosity ink or increasing the discharge amount, the voltage Vgh may be set to be higher while satisfying the second expression.

Fourth Embodiment

A printing element substrate $I_4$ according to the fourth embodiment will be described with reference to FIG. 10. The third embodiment has exemplified the arrangement in which a plurality of units U form a plurality of groups G which operate according to the time-divisional driving method. However, the present invention is not limited to this arrangement. For example, a plurality of groups G may be arrayed to form two arrays (or three or more arrays), as on the printing element substrate $I_4$ exemplified in FIG. 10.

Printing elements of the respective arrays (printing element arrays) can correspond to inks of different types. For example, heaters 101 of the first array, and heaters 201 of the second array can be designed with specifications (for example, shape, size, and resistance value) corresponding to the respective types. Also, a transistor 102 which supplies a constant current to each heater 101, and a transistor 202 which supplies a constant current to each heater 201 may be designed with specifications corresponding to the respective types. This also applies to transistors 103 and 203, power supply lines 104 and 204, and the remaining building components.

Figure 10:
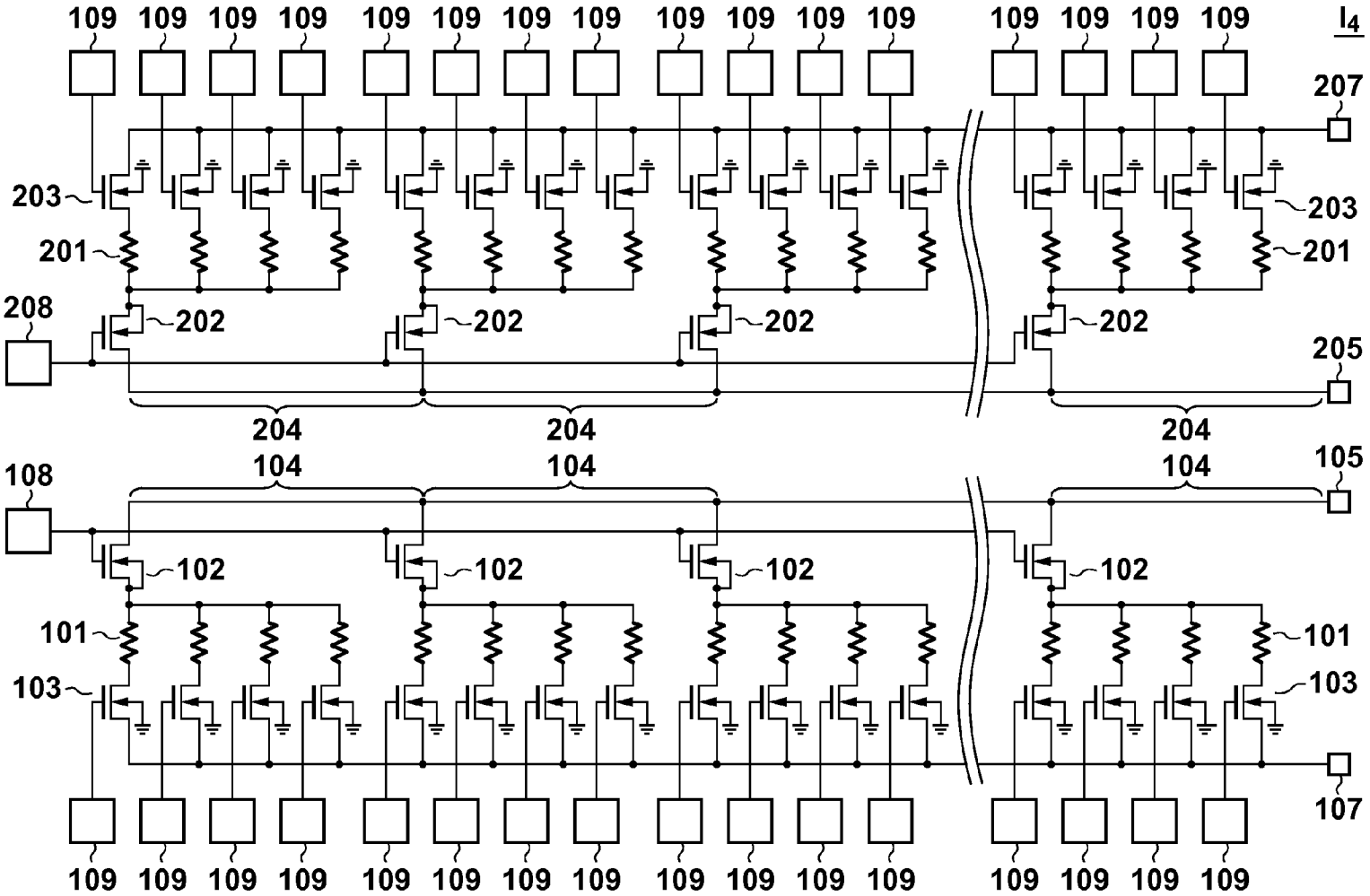
FIG. 10 is a circuit diagram for explaining another example of part of the circuit arrangement of the printing element substrate.

Power supply electrodes 105 and 205 are shown individually in FIG. 10, but may be formed from a common electrode. This also applies to GND electrodes 107 and 207. Further, k=1 to N, and the transistors 103, heaters 101, and transistors 102 are arranged in order from the outer sides of these two arrays on the two arrays, that is, the first printing element array and second printing element array. By arranging the transistors 102 between these two arrays, the drain regions of the transistors 102 may be shared between these two arrays.

As described above, the fourth embodiment can obtain the same effects as those of the first to third embodiments. In addition, printing element arrays corresponding to inks of different types can be designed individually.

Note that a condition which should be satisfied by a constant voltage Vgh1 supplied from a power supply unit 108 to the gate terminal of the transistor 102, and a constant voltage Vgh2 supplied from a power supply unit 208 to the gate terminal of the transistor 202 can be obtained using the above-described second expression. For example, Vh=32 [V], N=32, $I_{ON1}$=100 [mA], $I_{ON2}$=80 [mA], $R_{h1}$=0.1 [Ω], $R_{h2}$=0.2 [Ω], and Vgl=5 [V]. $I_{ON1}$ represents the amount of current flowing through one heater 101, and $R_{h1}$ represents the wiring resistance between the adjacent transistors 102 in a line pattern corresponding to the power supply nodes 104. $I_{ON2}$ represents the amount of current flowing through one heater 201, and $R_{h2}$ represents the wiring resistance between the adjacent transistors 202 in a line pattern corresponding to the power supply nodes 204. According to the second expression, 5 [V]<Vgh1<26.72 [V], and 5 [V]<Vgh2<23.55 [V]. In this manner, the voltages Vgh1 and Vgh2 may be set in accordance with the ink types as long the second expression is satisfied.

Although the four embodiments have been described above, the present invention is not limited to them. Changes can be appropriately made in accordance with the purpose, state, application, function, and other specifications, and the present invention can also be implemented by another embodiment. For example, an inkjet arrangement using heaters has been exemplified as a printing apparatus, but the present invention is not limited to this arrangement and is applicable to even a printing apparatus of another known driving type. The concept of printing can include not only formation of significant information such as characters and graphics, but also formation of insignificant information. As the printing medium, a printing sheet has been exemplified. However, the printing medium includes cloth, a plastic film, a metal plate, glass, ceramics, a resin, wood, and leather as long as it can accept ink. Further, the concept of ink can include a liquid which can form images, figures, patterns, and the like on a printing medium, like a general ink, and can also include, for example, a liquid used for ink processing such as solidification or insolubilization of a coloring agent contained in ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-132025, filed Jun. 24, 2013, which is hereby incorporated by reference herein in its entirety.

What is claimed is:

1. A printing element substrate comprising a plurality of units configured to print on a printing medium based on print data, each of the plurality of units including:

a printing element configured to print on the printing medium;

a first transistor configured to operate as a source follower upon receiving a voltage at a gate terminal of the first transistor, and supply a current to the printing element; and a second transistor configured to control supply of the current to the printing element in response to a control signal input to a gate terminal of the second transistor, wherein the first transistor and the second transistor are transistors of a same conductivity type.

2. The substrate according to claim 1, wherein the first transistor includes a source terminal and a back gate terminal connected to each other.

3. The substrate according to claim 1, wherein supply of a voltage to the gate terminal of the first transistor is performed in synchronism with supply of a voltage to a drain terminal of the first transistor.

4. The substrate according to claim 1, wherein the printing element substrate further comprises a first pad configured to receive a first voltage from outside, and a second pad configured to receive a second voltage from outside, the printing element includes a first terminal and a second terminal, the first transistor is arranged to form a current path between the first terminal and the first pad, the second transistor is arranged to form a current path between the second terminal and the second pad, and a wiring resistance between the second pad and the second transistor is lower than a wiring resistance between the first pad and the first transistor.

5. The substrate according to claim 1, wherein the printing element includes a first terminal and a second terminal, the first transistor and the second transistor are n-channel transistors, the first transistor is arranged to form a current path between the first terminal and a power supply node, and the second transistor is arranged to form a current path between the second terminal and a ground node.

6. The substrate according to claim 1, wherein the printing element includes a first terminal and a second terminal, the first transistor and the second transistor are p-channel transistors, the first transistor is arranged to form a current path between the first terminal and a ground node, and the second transistor is arranged to form a current path between the second terminal and a power supply node.

7. The substrate according to claim 1, wherein the first transistor includes a first DMOS transistor, and the first DMOS transistor includes:

a first p-type well arranged in a p-type semiconductor region in a semiconductor substrate;

a first n-type well arranged in the p-type semiconductor region to surround the first p-type well, and configured to electrically isolate the first p-type well and the p-type semiconductor region;

a first drain region arranged in the first n-type well;

a first source region arranged in the first p-type well;

a first gate electrode arranged on an insulating film on a region between the first drain region and the first source region; and a first p-type diffusion region arranged in the first p-type well, and configured to supply a potential to the first p-type well.

8. The substrate according to claim 7, wherein the second transistor includes a second DMOS transistor, and the second DMOS transistor includes:

a second p-type well arranged in the p-type semiconductor region;

a second n-type well arranged in the p-type semiconductor region to contact a side surface of the second p-type well;

a second drain region arranged in the second n-type well;

a second source region arranged in the second p-type well;

a second gate electrode arranged on an insulating film on a region between the second drain region and the second source region; and a second p-type diffusion region arranged in the second p-type well, and configured to supply a potential to the second p-type well.

9. The substrate according to claim 1, wherein each of the plurality of units includes:

a second printing element; and a third transistor configured to control supply of a current to the second printing element in response to a control signal input to a gate terminal of the third transistor, and the first transistor supplies a current to the second printing element.

10. The substrate according to claim 9, wherein the third transistor includes a third DMOS transistor, the third DMOS transistor shares, as a source region, a source region of the second transistor, and the third DMOS transistor includes, independently of the second transistor, a third n-type well, a third drain region arranged in the third n-type well, and a third gate electrode arranged on an insulating film on a region between the third drain region and the source region.

11. The substrate according to claim 9, wherein the plurality of units includes a first unit and a second unit which are arranged to be adjacent to each other, the printing elements and the second printing elements of the first unit and second unit are arranged between the second transistor and the third transistor of the first unit, and the second transistor and the third transistor of the second unit, and the first transistors of the first unit and second unit are arranged between the printing element and the second printing element of the first unit, and the printing element and the second printing element of the second unit.

12. The substrate according to claim 11, further comprising a control unit configured to output a control signal to the gate terminals of the second transistor and third transistor so as to drive the printing elements and the second printing elements in the first unit and the second unit by a time-divisional driving method.

13. The substrate according to claim 1, wherein the first transistor operates in a saturation region, and the second transistor operates in a non-saturation region.

14. A printhead comprising:

a printing element substrate defined in claim 1;

an orifice configured to discharge ink in response to driving of the printing element; and an ink supply unit configured to supply the ink to the orifice.

15. A printing apparatus comprising:

a printhead defined in claim 14; and a printhead driver configured to drive the printhead.

16. A printing element substrate comprising a plurality of units configured to print on a printing medium based on print data, each of the plurality of units including:

a printing element configured to print on the printing medium;

a first transistor configured to operate as a source follower upon receiving a voltage at a gate terminal of the first transistor, and supply a current to the printing element; and a second transistor configured to control supply of the current to the printing element in response to a control signal input to a gate terminal of the second transistor, wherein the printing element substrate further comprises a first pad configured to receive a first voltage from outside, and a second pad configured to receive a second voltage from outside, the printing element includes a first terminal and a second terminal, the first transistor is arranged to form a current path between the first terminal and the first pad, the second transistor is arranged to form a current path between the second terminal and the second pad, and a wiring resistance between the second pad and the second transistor is lower than a wiring resistance between the first pad and the first transistor.

17. A printing element substrate comprising a plurality of units configured to print on a printing medium based on print data, each of the plurality of units including:

a printing element configured to print on the printing medium;

a first transistor configured to operate as a source follower upon receiving a voltage at a gate terminal of the first transistor, and supply a current to the printing element; and a second transistor configured to control supply of the current to the printing element in response to a control signal input to a gate terminal of the second transistor, wherein each of the plurality of units includes:

a second printing element; and a third transistor configured to control supply of a current to the second printing element in response to a control signal input to a gate terminal of the third transistor, and the first transistor supplies a current to the second printing element.

* * * * *